United States Patent [19]

Connor et al.

[11] 4,014,806

[45] Mar. 29, 1977

[54] NOVEL ORGANOPOLYPHOSPHATES IN AQUEOUS CLEANING COMPOSITIONS

[76] Inventors: David Connor, Ben Y Groes, Swallow Hill, Disington, Cumberland, England; Francesco Cuciti, Via Wildt 7, 40043 Castiglione delle Stiviere, Mantova, Italy; Edward James Lowe, Four Locks House, Stourton, near Stourbridge, Worchestershire, England

[22] Filed: Dec. 7, 1973

[21] Appl. No.: 420,579

[52] U.S. Cl. ..... 252/110; 252/121; 252/135; 252/173; 252/526; 252/540; 252/545; 252/DIG. 14

[51] Int. Cl.[2] ..... C11D 3/065; C11D 3/30; C11D 3/36; C11D 17/08

[58] Field of Search ..... 71/35, 83, 86, 121; 252/109, 135, 526, 545, 173, DIG. 14, 156, 540, 110

[56] References Cited

UNITED STATES PATENTS

| | | | |
|---|---|---|---|
| 2,338,987 | 1/1944 | Watzel | 252/526 |
| 2,906,601 | 9/1959 | Koster | 252/135 X |
| 2,950,961 | 8/1960 | Striplin | 71/42 |
| 3,122,508 | 2/1964 | Grifo | 252/135 |
| 3,147,295 | 9/1964 | Laughlin | 252/135 X |
| 3,232,880 | 2/1966 | Mausner | 252/526 |
| 3,328,309 | 6/1967 | Grifo | 252/135 X |
| 3,537,814 | 11/1970 | Farr | 23/107 |
| 3,572,990 | 3/1971 | Farr | 71/43 |
| 3,723,074 | 3/1973 | Sears | 423/307 |
| 3,775,315 | 11/1973 | Smith | 252/1 |

FOREIGN PATENTS OR APPLICATIONS

| | | | |
|---|---|---|---|
| 1,245,979 | 8/1967 | Germany | 252/526 |
| 919,249 | 2/1963 | United Kingdom | 252/526 |

*Primary Examiner*—Dennis L. Albrecht
*Attorney, Agent, or Firm*—Flynn & Frishauf

[57] ABSTRACT

Novel organic polyphosphate mixtures are made by a process comprising a mixture of a plurality of polyphosphate salts of one or more primary, secondary or tertiary amines; which mixture has been obtained by a process comprising (1) forming an aqueous polyphosphoric acid solution comprising from 80 to 88% by weight of phosphorus penitoxide; (2) reacting said polyphosphoric acid solution with a primary, secondary or tertiary amine at a pH of from 4 to 12 and at a temperature of from 15 to 70° C.

Such mixtures are useful as builders in liquid cleaning compositions comprising surface active agents or alkali metal hydroxides or silicates with which they are more compatible in aqueous solution then are previously used polyphosphate builder materials.

1 Claim, No Drawings

NOVEL ORGANOPOLYPHOSPHATES IN AQUEOUS CLEANING COMPOSITIONS

This invention relates to liquid cleaning compositions comprising a polyphosphate builder. Such compositions include both liquid detergent solutions comprising a surface active agent such as are currently employed as dishwashing and textile detergents or highly alkaline solutions comprising little or no surface active agent such as are used for cleaning hard surfaces, e.g.. the insides of ovens, and for machine dishwashing, bottle washing and beer keg washing. The present compositions may be in various degrees of aqueous dilution and in the extreme case may be stable suspensions or gels. In the gel form they may be used as cosmetic detergents, e.g. shaving creams. Polyphosphate builders are useful in all such compositions both for their sequestering effect in heavy metal ions, notably calcium ions, and for their detergent 'builder' properties additional to the sequestering effect.

Considerable efforts have been made over the last twenty years or so to provide satisfactory built cleaning compositions of the types instanced above, but as yet a number of problems remain.

The difficulties arise from the variegated nature of the necessary ingredients coupled with the properties the liquid cleaning compositions must possess. In the case of compositions comprising surface active agents in solution the primary problem may be expressed as that of providing a composition which has a sufficient concentration of surface active agents and builder in the same solution but which at the same time is homogeneous, has a chill point well below room temperature, and a short re-liquefaction time at room temperature after storage at low temperatures. In addition, the solution should be sufficiently concentrated that a moderately sized container of it will provide an acceptable number of washings — say about as many washings as an equivalent sized container of solid detergent. All these requirements are onerous in that they press on the compatibility of the builder and the surface active agents. Compatibility limitations are often aggravated by the need for further ingredients such as silicate (as a corrosion inhibitor), suds builders and organic solvents. In the case of highly alkaline liquid cleaning compositions comprising little or no surface active agent, similar problems arise in relation to the compatibilities in aqueous solution of the phosphate builder and the alkaline ingredient, normally a caustic alkali or a sodium silicate. Previous attempts to mitigate these problems fall into three main classes, consisting in selecting either a particular builder or where appropriate, a particular surface active agent which will maximise compatibility, or in incorporating a further homogenizing ingredient. Combinations of these approaches are also used. However, success on these lines has so far been partial. The scope for altering the surface active ingredient (where used) is limited by the required detergency characteristics which is to say that not all surface active agents have the foaming properties (either high or low foaming ability may be wanted), mildness, washing ability and low cost required for use in liquid detergents. A notable difficulty arises with non-ionic surface active agents having the low foaming properties essential in liquid detergents for use in automatic dishwashing machines as well as other desirable washing properties. Such non-ionics may be difficultly soluble in concentrated alkaline builder solutions unless certain specialised ingredients are added to bring about compatibility (see for example BP 991, 980). Possible variations of the nature of the builder employed are fewer. Perhaps the most widely favoured builder is potassium pyrophosphate. Whilst acknowledged mainly on account of its lower sequestering ability for calcium and magnesium ions to be less effective than other available polyphosphate builders such as sodium tripolyphosphate, this compound is relatively free from disadvantages of limited solubility and hydrolysis in aqueous solutions which attach to the latter. However, even potassium pyrophosphate is not as soluble and compatible with surface active agents or with alkaline reagents as might be desired.

Homogenizing agents, to increase compatibility, are also widely used in many types of cleaning compositions. Chief among these are the so-called "hydrotropes", notably sodium or potassium benzene, toluene and xylene sulphonates and triamyl phosphate. Various organic copolymers have also been suggested (see e.g. BP No. 943,353) and "assistant solubilizers" such as ethanol or diethylene glycol have been proposed. The disadvantage of all these additional ingredients is that they contribute little or nothing to the actual performance of the composition so tha the expense of their preparation must be charged solely to achievement of higher concentrations of detergents or alkali builder in solution. Moreover, the dilution of the cleansing effect resulting from the use of such homogenizers lessens the effectiveness of the composition.

We have now discovered a range of polyphosphate builder suitable for use in liquid cleaning compositions which considerably reduce the aforesaid disadvantages in comparison wih the aforementioned previously used polyphosphate builder.

The invention provides a mixture of a plurality of polyphosphate salts of one or more primary, secondary or tertiary amines, which mixture has been obtained by a process comprising reaction of an aqueous polyphosphoric acid solution comprising from 80 to 88% by weight of phosphorus pentoxide with one or more primary, secondary or tertiary amines without any substantial hydrolysis of the polyphosphoric acid species present in the polyphosphoric acid solution.

From a further aspect, the invention provides liquid aqueous cleaning compositions comprising in a mixture of polyphosphate salts as aforesaid together with one or more cleaning adjuvents selected from the groups consisting of surface active agents, alkali metal hydroxide and alkali metal silicates.

In particular, the following advantageous properties may be listed:

1. High sequestering ability for calcium and magnesium ions.
2. Exceptionally good detergent builder properties in addition to sequestering ability;
3. Compatibility in aqueous solution with highly alkaline reagents and surface active agent far greater than that of conventional builder solutions;
4. Considerably greater viscosities over a broad range of solids contents than have the majority concentrated builder solutions of equivalent solids contents.

It is to be understood that whilst the mixtures are not necessarily superior to conventional builders in all the above respects, they are nevertheless uniquely valuable in the combination of these properties which they possess.

A particularly valuable and unlooked for property is that aqueous solutions of the mixtures may, within certain proportion ranges, depending upon the amine involved, comprise concentrations of the said polyphosphate salt mixture in excess of the solubility limit for a true solution whilst remaining as stable suspensions or gels which are useful as builders for paste type cleaning agents such as oven cleaners and other highly alkaline hard surface cleaners as well as cosmetic cleaners in paste form such as shaving creams. The aqueous cleaning compositions of the invention are accordingly defined herein as including solutions wherein the polyphosphate mixtures are in SOl and suspension form as well as in true solutions. Mixtures as hereinbefore defined which are in the form of stable aqueous suspensions constitute a preferred aspect of this invention. In general such suspension-type solutions will comprise from 35 to 60% by weight of polyphosphate mixture expressed as weight of $P_2O_5$ on the total weight of polyphosphate mixture-plus-water present. However, the minimum concentration at which the suspensions are formed varies somewhat with the nature of the cation and suspensions of the invention may variously comprise from 35 to 50, 40 to 50, 40 to 60 and 45 to 60% by weight of the polyphosphate mixture (in the aforesaid basis) depending upon the amine concerned.

The builder solutions are obtained from aqueous polyphosphoric acid solutions comprising from 80 to 88 by weight of phosphorus pentoxide ($P_2O_5$). Such aqueous polyphosphoric acid solutions may be made by conventional means such as concentration of orthophosphoric acid solutions, dilution of polyphosphoric acid solutions of greater than the desired $P_2O_5$ itself in water. The polyphosphoric acid species present in such solutions are in equilibrium and the overall composition is governed solely by the overall $P_2O_5$ contact as described, for example in the Canadian Journal of Chemistry Vol. 34 (1956) page 790. Preferred $P_2O_5$ concentrations are from 82 to 86% by weight $P.O_5$. Whilst the presence of other materials in the polyphosphoric acid solutions is not excluded it is desirable that these solutions be substantially unadulterated and polyphosphoric acid solutions derived by any of the abovementioned procedures from $P_2O_5$ obtained by the burning of electrothermally produced phosphorus are preferred. Polyphosphoric acid solutions derived by solution in $P_2O_5$ of "wet process" phosphoric acid obtained by acidification of phosphatic rock are less preferred.

The mixtures in aqueous solution may be obtained by the reaction of the polyphosphoric acid solutions with a primary, secondary or tertiary amine. In the term 'amine' as used herein are included all compounds other than amides, having an amino grouping i.e., all compounds having an amino grouping, other than one attached to a carboxyl group, regardless of the other constituents of the molecule so that, for example, this term includes amino acids and substituted amines such as alkanclamines. Preferred amines have molecular weights below 200, most preferably below 150. Particularly valuable amines include mono-, di- and triethanolamines and propanolamines, morpholine, mono-, di-, and tri-ethyl, n-propyl, iso-propyl and n-, iso- and sec-butylamines. Other amines which may be used include N,N-dimethylethanolamine, amincethylethanolamine, N-2-aminoethylethanolamine, N-methyldiethanolamine, N-methylmorpholine, N-ethylmorpholine, N,N diethylethanolamine, N-methylethanolamine.

It may be desirable to effect the reaction step simultaneously with a dilution to bring about the desired final concentration of the builder solution, provided that such dilution does not bring about hydrolysis of the polyphosphate anion species present. It is characteristic of the builder solutions for present use that the spectrum of polyphosphate anions present, substantially corresponds to that present in the original polyphosphoric acid solution. Hydrolysis of polyphosphate anions is preferably avoided by maintaining the pH of the reaction medium in the range 4–12, preferably 6–12, most preferably 7–10 — below 70° C, preferably below 40° C, say 15° C to 70° C or 15° to 40° C.

The mixtures for present use are preferably those obtainable by reaction of the said phosphoric acids and amines in 1 : 1 ratio of acid hydrogen atoms in the polyphosphoric acid(s) to hydrogen atoms bonded to nitrogen in the amine but compounds obtainable by partial neutralisation of amine with polyphosphoric acid also have utility. In the general case the builders will be compounds obtainable by reaction of polyphosphoric acid(s) with amine in from 1 : 50 to 10 : 1 - e.g. 1 : 10 to 5 : 1say 1 : 4 to 2 : 1 preferably 1 : 1 to 2 : ratio expressed as ratio of amine groups to phosphorus atoms.

In any case, reaction between amine and the polyphosphoric acid mixture preferably proceeds to a final pH of from 4 to 12, preferably 4 to 10, most preferably 6 to 10.

The mixtures are conveniently obtained in aqueous solution by straightforward addition of the amine or the aqueous solution thereof to an aqueous solution of the polyphosphoric acid(s) followed by concentration or dilution as required for the proposed use.

Solutions of the builders thus formed may also be dried by conventional means to provide a solid builder by incorporation into solid detergent formulations with other conventional ingredients. Such solid detergent formulations constitute a further aspect of the invention.

The novel mixtures may be present in the novel cleaning compositions in a wide range of concentrations depending upon the envisaged application and upon the solubility of the mixture, but in general they will be present in concentrations of from 4 to 25% by weight, more usually from 6 to 18%, e.g. from 10 to 15% by weight (all these percentages being expressed as percentages of $P_2O_5$ from the respective polyphosphates) on the total weights of the compositions. Aqueous solutions of the polyphosphate mixtures as hereinbefore defined comprising at least 4%, preferably at least 10% thereof, on the aforesaid basis constitute a further aspect of this invention. Preferred such solutions comprise from 6 to 18%, more specially from 10 to 16% by weight of the mixture on the aforesaid basis.

The proportion of surface active agent (where present) in the novel compositions may vary within wide limits just as with known such compositions, depending upon the use in question. In the general case, novel compositions will comprise from 0.05 to 70% by weight of surface active agent and in particular cases may comprise say from 0.1 to 5% e.g. 0.5 to 3% by weight in the case of a hard surface cleaner and from 10–60%, say 20 to 50%, e.g. 20–30% in the case of a heavy duty liquid detergent. Most usually the proportion will be from 0.1 to 0.5 to 60% or 70% more usually from 1.2, or 3% to 50, 60 or 70% by weight.

The surface active agents which may be employed in the novel compositions include non-ionic, anionic, cationic and amphoteric surface active agents, generally such as these mentioned in volume 19, pages 507–566 of the encyclopaedia of Chemical Technology, Second Edition by Kirk-Othmer, published by Interscience 1969, the relevant disclosure of which is hereby incorporated by reference herein.

Particular surface active agents which may find use in the novel compositions include: alkyl aryl sulphonates such as lithium, sodium, potassium, ammonium or other water-soluble salts of sulphonic acids of alkyl-substituted benzenes such as decyl toluene, dodecylxylene, octylbenzene, nonylbenzene, decylbenzene, tridecylbenzene, tetradecylbenzene, pentadecylbenzene, dodecylbenzene and hexadecylbenzene.

Olefine sulphonates such as water-soluble alkali metal and alkaline earth metal mono or di-olefin sulphoric acids comprising from 8 to 24 carbon atoms.

Alkali metal or ammonium alkyl sulphates in which the alkyl groups have from 10 to 18 carbon atoms and polyoxyethylenated and polyoxypropylenated derivatives therof:

Alkali metals or ammonium salts of alkane sulphonates:

Alkali metal or ammonium salts of sulphosuccinated materials of the average general formula:

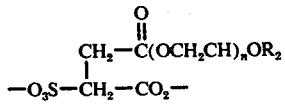

wherein is from 0 to 25, R is hydrogen or a methyl group and $R_2$ an alkyl group having from 8 to 25 carbon atoms.

Amine oxides such as those described in BP 943,353 having the formula $R_1R_2R_3NO$, wherein $R_1$ is an alkyl radical having from 9 to 25, preferably 10 to 16 carbon atoms and $R_1$ and $R_2$ are methyl or ethyl groups:

Betaines of the general formula

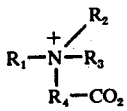

wherein $R_2$ and $R_3$ are alkyl or alkenyl groups containing from 1 to 6 carbons atoms and are preferably methyl groups, $R_4$ is an alkyl group containing from 1 to 6 carbon atoms and $R_1$ is an alkyl or alkenyl group containing from 8 to 18 carbon atoms:

Polyoxethylene compounds of the general formula $RO(CHCHR^1O)_xH$ where R is an alkyl, aryl, alkaryl, alicyclic, acyl, amino or alkylamino group; $R^1$ is hydrogen or an alkyl group having from 1 to 4 carbon atoms and $x$ is from 3 to 100, usually from 6 to 50. Such compounds include fatty alcohol $p$ polyethyoxylates, fatty acid polyethoxylates, polyethylene glycol ethers, mixed polyethylene and polypropylene glycol ethers, amine and diamine polyethoxylates, and fatty alkylolamide ethoxylates:

Fatty alcohol phosphates and polyethoxylated and polypropyloxylated derivatives thereof:

Fatty acid soaps.

The novel compositions comprising surface active agents will normally be compounded by addition of an aqueous solution of the surface active agent (or agents) used to a solution of the polyphosphate mixture, optionally followed by dilution although other means may also be used.

In the case of highly alkaline cleaners of the invention comprising little or no surfactant, the proportion of polyphosphate salt mixture will generally represent from 2 to 20% by weight (expressed as $P_2O_5$) in the composition, preferably 5 to 15%, whilst the alkaline component or components, which will normally be sodium hydroxide and/or an alkali metal silicate salt such as sodium metasilicate will generally be present in a proportion of from half to twice by weight of the weight of the polyphosphate salt mixture (expressed as weight of solid material). In the case of caustic alkalis such as sodium and potassium hydroxides, these might typically represent from 10–15% by weight of the total solids content of the composition. Where alkali metal silicate salts are used, these might typically represent from 25 to 40% by weight of the total solids content of the composition. Alkali metal silicates for present use are preferably those having an $M_2O$: Si: $O_2$ ratio of from 0.5 : 1 to 2 : 1 where this sodium or potassium, sodium metasilicate being particularly preferred.

The novel compositions may also comprise known adjuvants for liquid cleaning compositions such as anti-soil redeposition agents, e.g., carboxymethyl cellulose, or polyvinyl pryrrolidone: optical brightening agents; perfumes: dyes: bacteriostats and bacteriocides; opacifying agents; colorants; sudsing agents, e.g., ethanolamides such as coconut ethanolamide and fatty alcohols such as lauryl alcohols; phase stabilisers such as lower aliphatic alcohols and homogenizing agents. Although the polyphosphate builders generally permit less homogenising agent to be present than would be necessary with conventional phosphate builders, the preferred compositions of the invention are those which incoude a so-called hydrotope such as an alkali metal, alkaline earth metal or ammonium salt of benzene-, naphthalene-, an alkylbenzene- or an alkyl napthalene-sulphonic acid having not more than 5 aliphatic carbon atoms. Preferred such hydrotopes are sodium xylene sulphonates (sold by Albright and Wilson Limited under the registered trade name 'Eltesol'), sodium toluene sulphonate, sodium benzene sulphonate and sodium naphthalene sulphonate. Preferably hydrotopes are present in the novel compositions in proportions of from 2 to 20% by weight, more preferably 2 to 10%, most preferably 3 to 5%. In the case of hard surface cleaners of the invention, it may also be desired to incorporate a chlorine-releasing agent which is preferably sodium hypochloride although chlorinated isocyanorates can also be used. Normally, chlorine-releasing agents, where used, will be present in a concentration such as to give from 0.5 to 3%, e.g. 1 to 2% available chlorine (w/v) which is roughly equivalent in the case of sodium hypochlorite. For 8–12% v/v sodium hypochlorite.

Compositions of the invention may be employed to advantage in a range of cleaning applications such as the cleaning of textiles, including wool, wood, leather, metal, earthenware, china and stone as well as for human use.

The invention is illustrated by the following Examples wherein Example 1 describes the preparation of solutions of sodium and potassium mixed polyphosphate salts for use according to the invention and Examples 2 to 6 described cleaning compositions of the invention.

The invention is illustrated by the following examples in which all parts are expressed on a weight basis and all proportions of proprietary surfactant ingredients are expressed in terms of active ingredient (a.i.) any water present in the surfactant as added being included in the given proportions of total water.

EXAMPLE 1

| | |
|---|---|
| A composition was made up as follows: | |
| Monoethanolamine polyphosphate comprising 36.75% by weight $P_2O_5$ and 63.25% by weight Monethanolamine | 8% expressed $P_2O_5$ |
| [1]Nansa SS 60 | 15% |
| [2]Empimin KSN 27 | 8% |
| Lauric/myristic monoethanolamide | 2% |
| [3]Eltesol SX 93 | 3.7% a.i. |
| Water | to 100% |

[1]Registered trade name for a 60% w/w aqueous paste of sodium dodecylbenzene sulphonate supplied by Albright & Wilson Limited.
[2]Registered trade name for a 27% aqueous solution of ethoxylated sodium lauryl sulphate comprising three ethylene exide groups per molecule supplied by Albright & Wilson Limited.
[3]Registered trade name for a 93% sodium xylene sulphonate supplied by Albright & Wilson Limited, the balance of the material being sodium sulphate and water.

The product was suitable for use as a dishwashing detergent for manual use, being a clear homogeneous liquid at ambient temperature. By contrast the same formulation wherein the monoethanolamine polyphosphate was replaced by tetrapotassium pyrophosphate at a level of 8% as $P_2O_5$ separated into two phases.

EXAMPLE 2

A composition was made up having the same composition as that of Example 1 save that it contained 12% (expressed $P_2O_5$) monoethanolamine polyphosphate and 4.7% Eltesol SX 93. Again, the composition was a clear homogeneous liquid at room temperature suitable for use as a dishwashing detergent.

By contrast, the same composition with sodium tripolyphosphate substituted at equivalent $P_2O_5$ content for the monoethanolamine polyphosphate separated into two distinct phases at room temperature. The same result was obtained when potassium pyrophosphate was likewise substituted for the monoethanolamine polyphosphate.

EXAMPLE 3

| | |
|---|---|
| A composition was made up as follows: | |
| Monoethanolamine polyphosphate | 16.8% (expressed as $P_2O_5$) |
| Nansa SS 60 | 15% a.i. |
| Lauric/myristic monoethanolamide | 2% |
| Eltesol SX 93 | 3.7% a.i. |
| Water to | 100% |

This composition was again a clear homogeneous liquid at room temperature suitable for use as a dishwashing detergent.

By contrast, replacement of the monoethanolamine polyphosphate by 16.8% (expressed as $P_2O_5$) of potassium pyrophosphate gave a composition which subsisted as two phases at ambient temperature.

EXAMPLE 4

| | |
|---|---|
| A composition was made up as follows: | |
| Isopropanolamine polyphosphate comprising 31.82% by weight $P_2O_5$ and 68.18% by weight isopropanolamine) | 12.6% (expressed as $P_2O_5$) |
| Nansa SS 60 | 12% a.i. |
| [1]Empimin KSN 60 | 6% a.i. |
| Lauric/myristic monoethanolamide | 2% |
| Eltesol SX 93 | 2.8% a.i. |
| Water to | 100% |

[1]Registered trade name for a sodium lauryl ethoxy sulphate comprising 3 ethylene oxide groups per molecule in 60% aqueous solution comprising 10% ethanol as solubiliser supplied by Albright & Wilson Ltd.

The composition was a clear, homogeneous liquid at ambient temperature, suitable for use as a dishwashing detergent. As in previous examples, replacement of the isopropanolamine polyphosphate by an equivalent amount of potassium pyrophosphate expressed as $P_2O_5$ gave a two-phase composition at ambient temperature.

EXAMPLE 5

| | |
|---|---|
| A composition was made up as follows: | |
| [(1)]Nansa SSA | 3% a.i. |
| Triethanolamine | 2% |
| Monoethanolamine | 1.5% |
| Coconut fatty acid | 8% |
| Monoethanolamine polyphosphate as used in example 1 | 9.6% (expressed as $P_2O_5$) |
| [(2)]Eltesol PCS 93 | 5% a.i. |
| [(3)]Empilan KA 5 | 5% a.i. |
| Water to | 100% |

[(1)]Registered trade name for a ca. 96% dodecylbenzene sulphonic acid supplied by Albright & Wilson Limited.
[(2)]Registered trade name for a 93% potassium cumene sulphonate, the balance being potassium sulphate and water, supplied by Albright & Wilson Limited.
[(3)]Registered trade name for a lauryl alcohol ethoxylate comprising approximately 60% by weight ethylene oxide supplied by Albright & Wilson Limited.

This composition was a clear, homogeneous liquid at ambient temperature and was suitable for use as a heavy duty liquid detergent for mechanical washing appliances.

By contrast, replacement of the monoethanolamine polyphosphate by an equivalent quantity of potassium pyrophosphate gave a two-phase composition at ambient temperature.

EXAMPLE 6

| | |
|---|---|
| A composition was made up as follows: | |
| monoethanolamine polyphosphate as used in example 1 | 12% (expressed as $P_2O_5$) |
| [(1)]Empilan PPE 2910 | 1% a.i. |
| Coconut fatty acid | 2% |
| triethanolamine | 0.4% |
| Eltesol PCS 93 | 5% a.i. |
| Water to | 100% |

[(1)]Registered trade name for a high molecular weight polycondensate of propylene and ethylene oxides supplied by Albright & Wilson Limited.

The composition was a clear, homogeneous solution suitable for use as a dishwashing detergent for mechanical washing. Replacement of the monoethanolamine polyphosphate by an equivalent amount of potassium pyrophosphate gave a composition which was a thick paste at ambient temperature.

EXAMPLE 7

| | |
|---|---|
| Two compositions were made up as follows: | |
| Composition 1 | |
| Monoethanolamine polyphosphate as used in Example 1 | 12% expressed as $P_2O_5$ |
| 30% aqueous solution of ethoxylated potassium lauryl phosphate comprising 5 ethylene exide groups per molecule and consisting essentially of a 1 : 1 per molar mixture of mono (laurylpentethoxy) phosphate and di (laurylpentethoxy) phosphate | 3.6% a.i. |
| Water to | 100% |

COMPOSITION 2

As (1) but with isopropanolamine polyphosphate (as used in Example 4) replacing monoethanolamine polyphosphate.

Both compositions (1) and (2) were clear, homogeneous liquids at ambient temperature, suitable for use as liquid detergents for hard surface cleaning.

By contrast, a composition wherein 12% (expressed as $P_2O_5$) of potassium pyrophosphate replaced the monoethanolamine (or isopropanolamine) polyphosphate separated into two distinct phases at ambient temperature.

-continued

| | |
|---|---|
| Monoethanolamine polyphosphate as used in Example 1 | 6% (expressed as $P_2O_5$) |
| Empilan PPE 2910 | 2% a.i. |
| Optical brightening agent | 0.2% |
| Bacteriocide | 0.1% |
| Perfume | 0.2% |
| Water | to 100% |

A further composition (2) of similar utility was also made to the same formulation save that 2% of Triton CF32 replaced the Empilan PPE 2910 (Triton CF32 is a registered trade name for a non-ionic surface active amine polyglycol condensate supplied by the Rohm & Haas Company).

| | |
|---|---|
| A composition (3) was also made up as follows: | |
| Nansa SSA | 10% a.i. |
| Triethanolamine | 4.4% |
| Monoethanolamine | 2.2% |
| Empicol SDD | 4% |
| Isopropanolamine polyphosphate as used in Example 4 | 6% (expressed as $P_2O_5$) |
| Optical brightening agent | 0.3% |
| Bacteriocide | 0.1% |
| Perfume | 0.1% |
| Water | to 100% |

EXAMPLE 8

| | |
|---|---|
| A composition was made up as follows: | |
| Monoethanolamine polyphosphate as used in Example 1 | 4% (expressed as $P_2O_5$) |
| + Empicol L Q 3 3 | 10% a.i. |
| – Empigen BB | 2% a.i. |
| Eltesol SX 93 | 2% |
| Water | to 100% |

+ Registered trade name for a 33% aqueous solution of monoethanolamine lauryl/myristyl sulphate supplied by Albright & Wilson Limited.

– Registered trade name for a 30% aqueous solution of alkyl dimethyl betaine represented by the formula R — $N^+$— $Me_2CH_2CO_2^-$ where R is predominately lauryl/myristyl supplied by Albright & Wilson Limited.

The composition was a clear homogeneous liquid at ambient temperature suitable for use as a liquid hand cleanser. By contrast a composition where potassium pyrophosphate replaced monoethanolamine polyphosphate at 4% $P_2O_5$ level was a heterogeneous paste at ambient temperature.

EXAMPLE 9

A composition (1) found highly suitable for both machine and hand washing of woollen garments was made up as follows:

| | |
|---|---|
| Nansa SSA | 10% a.i. |
| Triethanolamine | 6% |
| Monoethanolamine | 3% |
| Empimin KSN 27 | 2.7% |
| Coconut fatty acid | 4% |

Empicol SDD:

registered trade name for a 40% aqueous solution of a disodium alkylethoxy sulphosuccinate halfester where the alkyl group are predominately lauryl/myristyl and the ethoxy group is primarily derived from diethylene glycol (supplied by Albright & Wilson Limited).

Composition 1 and 2 were of the 'low-foam'type incorporating coconut fatty acid soap with either Empilan PPE 2910 or Triton CF 32 as foam depressants. All three compositions (1) (2) and (3) were clear homogeneous liquids at room temperature.

Each of these compositions was compared in standard washing tests to a typical conventional detergent powder of the following composition:

| | |
|---|---|
| Sodium dodecylbenzene sulphonate | 9% |
| Fatty alcohol polyethoxylate (11 mols. $Et_2O$) | 4% |
| Sodium silicate 1 : 2 | 5% |
| Sodium tripolyphosphate | 42% |
| Optical brightening agent | 0.49% |
| + Alcalase P | 0.5% |
| Perfume | 0.2% |
| Moisture | 10% |
| pH (1% solution) ca. 10 | |

+ a proteclytic enzyme supplied by Novo Industria SA

The effectiveness of compositions 1, 2 and 3 and of the reference powder was then determined in duplicate standard washing tests. These involved subjecting 40 3 inch by 3 inch swatches of a standard test cloth to the rotating washing action of a launder-O-meter supplied by the Atlas Electrical Device Co. (Chicago). Swatches were washed in pairs (two swatches per cylinder of the leading table) with the addition of 2g of the composition under test to each cylinder. Washing was at 80° C, using water of given hardness proceeded for 20 minutes following which the swatches were rinsed, ironed dry between cotton coths and then compared for light reflectance using Harrison colour measurements with a white tile reference and a light source filtered through a green filter. Results are quoted as percentages calculated from the equation:

$$\% = \frac{100 \times (\text{Reflectance A (washed)} - \text{Reflectance A (unwashed)})}{(\text{Reflectance R (washed)} - \text{Reflectance R (unwashed)})}$$

Where reflectance A is the colour scale reading of the swatch washed in the composition under test and reflectance R is the colour scale reading of the swatch washed in the reference composition.

One series of tests was carried out using standard soiled wool swatches reference Empa 102 (supplied by Empa Laboratories, Switzerland) using both water of hardness 50 ppm ($CaCO_3$) and water of 300 ppm ($CaCO_3$) hardness — the atomic ratio of Ca: Mg present in the water being 4 : 1 in both cases. Results were as follows:

| | Soft Water (%) | Hard Water (%) |
|---|---|---|
| Reference Powder | 100 | 100 |
| Composition 1 | 92.6 | 86.8 |
| Composition 2 | 87.6 | 86.8 |
| Composition 3 | 95.0 | 90.0 |

These results are within the range for a liquid detergent compared with a powder detergent and compare favourably with results obtainable from conventional liquid detergents as is demonstrated below.

Similar tests were also carried out using soiled polyester/cotton swatches (60/40 Dacron/Cotton) supplied by Test Fabrics Inc. with the following results:

| | Soft Water (%) | Hard water (%) |
|---|---|---|
| Reference Powder | 100 | 100 |
| Composition 1 | 89.3 | 118 |
| Composition 2 | 75.0 | 122.7 |
| Composition 3 | 93.8 | 124 |

Here it may be seen that the performances of compositions of the invention actually surpass that of the reference powder under the most testing washing conditions, that is in hard water.

Washing colour stability tests were also carried out on compositions 1, 2 and 3 according to I.W.S. method number 105 using standard dyed woollen fabrics. Assessment of colour change and staining were carried out on the British Standards Institute Grey Scale, the preferred total being 27 points minimum.

| | |
|---|---|
| Reference Powder | 23.5 Points |
| Composition 1 | 30.5 Points |
| Composition 2 | 30.5 Points |
| Composition 3 | 32.0 Points |

To further demonstrate the improved effectiveness of the composition of the invention their performance was compared with those of similar compositions made up using conventional polyphosphate molecules at approximately the highest concentration possible without causing cloudiness or precipitation or phase separation at lower temperatures (i.e. the highest concentrations possible for a commercially acceptable composition) These conventional formulations (A B C and D) were as follows:

| | | |
|---|---|---|
| A. | NANSA SS60 | 10.0% |
| | Empimin KNS 27 | 10.0% |
| | Tetrapotassium pyrophosphate | 6.5% (expressed as $P_2O_5$) |
| | + Empilan CDE | 2.5% |
| | Eltesol SX 93 | 9.0% |
| | Optical Brightening Agent | 0.2% |
| | Bacteriocide | 0.1% |
| | Perfume | 0.2% |
| | Water | to 100% |

+ Registered trade name for a surface active diethanolamide derivative of "total" coconut fatty acid supplied by Albright & Wilson Limited.

| | | |
|---|---|---|
| B. | NANSA SS60 | 8.5% |
| | + Empicol ESB 3 | 13.0% |
| | Empilan CDE | 1.0% |
| | Tetrapotassium pyrophosphate | 5.0% (expressed as $P_2O_5$) |
| | Eltesol SX 93 | 5.0% |
| | Optical brightening agent | 0.2% |
| | Bacteriocide | 0.1% |
| | Perfume | 0.2% |
| | Water | to 100% |

+ Registered trade name for a 27.5% aqueous solution of sodium lauryl ethoxy sulphate comprising two ethylene oxide per molecule.

| | | |
|---|---|---|
| C. Triethanolamine dodecylbenzene sulphonate | 14% | |
| Empimin KSN 27 | 4.0% | |
| Tetrapotassium pyrophosphate | 6.5% | (expressed as $P_2O_5$) |
| Coconut fatty acid soap | 5.0% | |
| Triton CF 32 | 4.0% | |
| = Eltesol SCS 93 | 2.0% | |
| Optical brightening agent | 0.2% | |
| Bacteriocide | 0.1% | |
| Perfume | 0.2% | |
| Water | to 100% | |

= Registered trade name for a 93% sodium cumene sulphonate - the balance being sodium sulphate and water - supplied by Albright & Wilson Limited.

| | | |
|---|---|---|
| D. Empilan KA 5 | 10% | |
| Empimin KSN 27 | 1.35% | |
| Tetrapotassium pyrophosphate | 3.5% | (expressed as $P_2O_5$) |
| Eltesol SX 93 | 5% | |
| Optical brightening agent | 0.2% | |
| Bacteriocide | 0.1% | |
| Perfume | 0.2% | |
| Water | to 100% | |

And the washing performance of these compositions A – D was compared with those of the above compositions 1 and 2 by the method as before against the same reference powder, Standard wool swatches (Empa 102) were used.

Results were as follows (quoted in the same basis as before):

| Composition | Soft Water (%) | Hard Water (%) |
|---|---|---|
| Reference Powder | 100 | 100 |
| 1 | 87 | 89.5 |
| 2 | 87 | 89.0 |
| A | 85 | 82 |
| B | 85 | 48.0 |
| C | — | 62.0 |
| D | 85.5 | 56 |

The improved detergent performance of the compositions 1 and 2 of the invention is clear from these results. This is especially evident in the tests using hard water where the sequestering ability of the polyphosphate builder is most critical.

A particularly striking comparison is that between the effect of composition C and those of 1 and 2. Although the latter contains less Empimin KSN 27 active ingredient, less coconut fatty acid less non-ionic surfactant and less "hydrotrope" (Eltesol SCS 93) they nevertheless exhibit improved detergent in hard water ascribable to the superior building properties of the polyphosphate builders of the invention over the conventional tetrapotassium pyrophosphate.

EXAMPLE 10

A monoethanolamine polyphosphate as used in Example 1 was prepared by addition at from 15° C to 40° C of an aqueous solution of polyphosphoric acid comprising 85% by weight phosphorus pentoxide to a stirred aqueous solution of monothanolamine. The product was an aqueous solution comprising 36.7% by weight $P_2O_5$ and 63.25% by weight monoethanolamine.

EXAMPLE 11

To 443g isopropanolamine in 297g water was added slowly, with stirring, at between 15 and 40° C 260g of a polyphosphoric acid solution comprising 85% by weight $P_2O_5$. The pH was between 4 and 10 throughout. The product was suitable for use according to Example 4.

We claim:

1. An aqueous cleaning composition consisting essentially of about 10% by weight of said composition of dodecyl benzene sulphonic acid, about 6% of triethanolamine, about 3% of monoethanolamine, about 2.7 of a 27% aqueous solution of ethoxylated sodium laurel sulphate containing three ethylene oxide groups per molecule, about 4% of coconut fatty acid about 6% of a polyphosphate consisting of 36.75% by weight $P_2O_5$ and 63.25% by weight monoethanolamine produced by reacting a polyphosphoric acid containing said $P_2O_5$ with monoethanolamine, about 2% of polyglycol condensate, and the remainder essentially water; said polyphosphate having been obtained by forming (i) an aqueous polyphosphoric acid solution comprising 82 to 86% by weight of phosphoric pentoxide, and (ii) reacting said phosphoric acid solution with monoethanolamine at a pH of from 4 to 12 and at a temperature from 15° to 70° C.

* * * * *